United States Patent [19]

Yates

[11] Patent Number: 4,899,501

[45] Date of Patent: Feb. 13, 1990

[54] EXPANDING ANCHORING DEVICE

[76] Inventor: Victor Yates, 8 Fairway Rd., Sewickley, Pa. 15143

[21] Appl. No.: 230,911

[22] Filed: Aug. 11, 1988

[51] Int. Cl.[4] ..... E02D 5/80

[52] U.S. Cl. ..... 52/160; 52/155; 52/159

[58] Field of Search ..... 52/156, 159, 160, 161, 52/155, 158, 165, 155

[56] References Cited

U.S. PATENT DOCUMENTS

| | | | |
|---|---|---|---|
| 825,587 | 7/1906 | Cook | 52/159 |
| 857,751 | 6/1907 | Parker | 52/159 |
| 1,455,163 | 5/1923 | Blackburn | 52/156 |
| 1,643,769 | 9/1927 | Heinrich | 52/159 |
| 1,899,520 | 2/1933 | Nettenstrom | 52/159 |
| 2,490,187 | 12/1949 | Young | 52/159 |
| 2,660,276 | 11/1953 | McKee | 52/159 |
| 2,672,961 | 3/1954 | Mead et al. | 52/159 |
| 2,899,029 | 8/1959 | Ballew | 52/159 |
| 3,349,526 | 10/1967 | Schuster | 52/160 |
| 3,778,943 | 12/1973 | Day | 52/160 |
| 4,491,447 | 1/1985 | Smith et al. | 411/15 |

FOREIGN PATENT DOCUMENTS

| | | | |
|---|---|---|---|
| 475449 | 9/1975 | U.S.S.R. | 52/160 |
| 2033039 | 5/1980 | United Kingdom | 411/54 |

*Primary Examiner*—Michael Safavi
*Attorney, Agent, or Firm*—William J. Ruano

[57] ABSTRACT

An expanding anchoring device comprising a shaft, base plate, and two pivotally mounted expansion members for engaging the inner surface of a pre-drilled hole.

The expansion members, in two forms of the anchoring device, can penetrate and expand into the sidewall of a pre-drilled hole by cutting a lateral notch in the sidewall.

In another form of this expanding anchoring device, the expansion members spring open when they are aligned with a pre-cut lateral notch in the sidewall of a pre-drilled hole.

1 Claim, 3 Drawing Sheets

EXPANDING ANCHORING DEVICE

This invention relates to an expandable anchoring device whose cutting action makes it applicable to engage various substances such as earth, rock, concrete, drywall, wood and other materials in which anchoring is desirable. This device is design to be inserted into a pre-drilled hole whose circumference is equal to that of the anchor being used. Once the anchor is inserted into the hole, two pivotal arm members will expand to either cut a lateral notch in the sidewall of the hole or simply expand into a pre-cut lateral notch for securing the anchoring device.

BACKGROUND OF THE INVENTION

An outstanding disadvantage of conventional anchoring devices is their limited application in a wide variety of anchoring situations. Different anchors must be used depending on the substance in which the anchor is being inserted.

Another disadvantage of conventional anchoring devices is their inability to allow variation of depth adjustment. Often times the thickness of the substance in which the anchor is to be secured will dictate the type or size of anchor which can be used.

SUMMARY OF THE INVENTION

An object of this invention is to provide a novel anchoring device which is devoid of the above-named disadvantages.

A more specific object of this invention is to provide an anchoring device which can be solidly secured in a wide variety of substances.

A further object of this invention is to provide an anchoring device which has a self-adjusting design in terms of depth insertion so as to allow the anchor to be inserted to whatever depth the application requires.

DESCRIPTION OF THE PREFERRED EMBODIMENT

Figure 2:
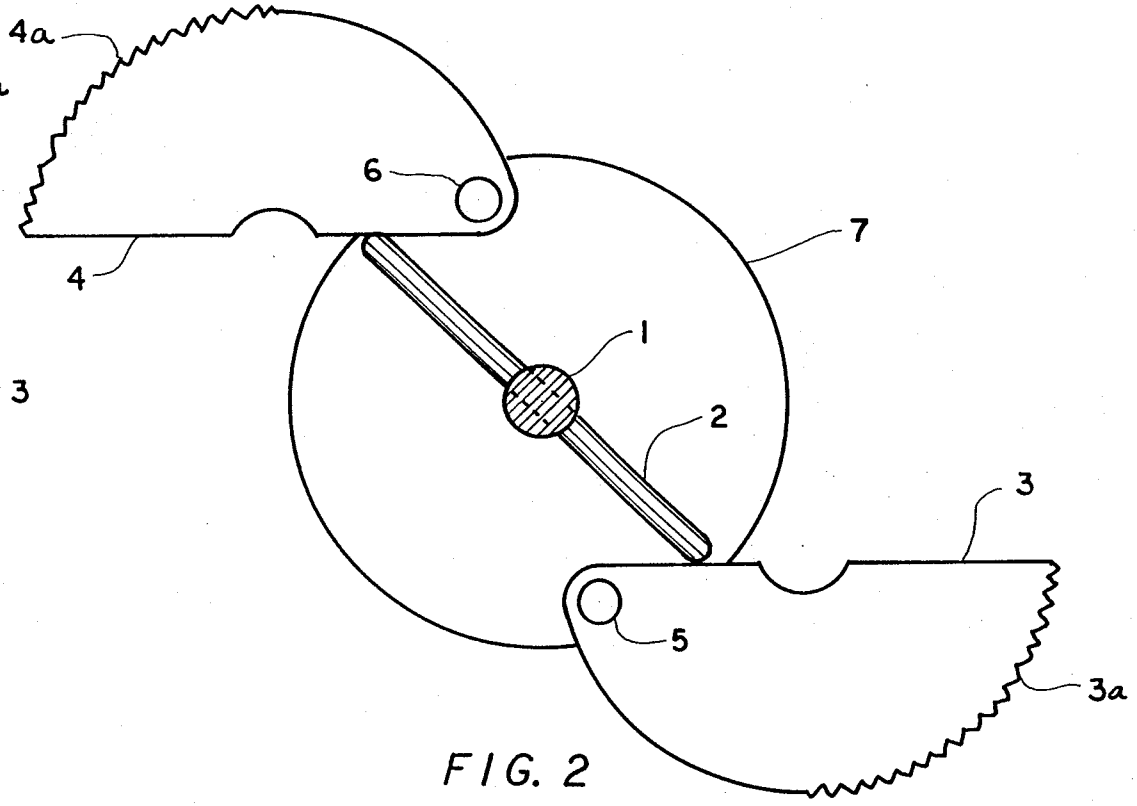
FIG. 2 is a top view of the anchoring after partial expansion has occurred.
Figure 1:
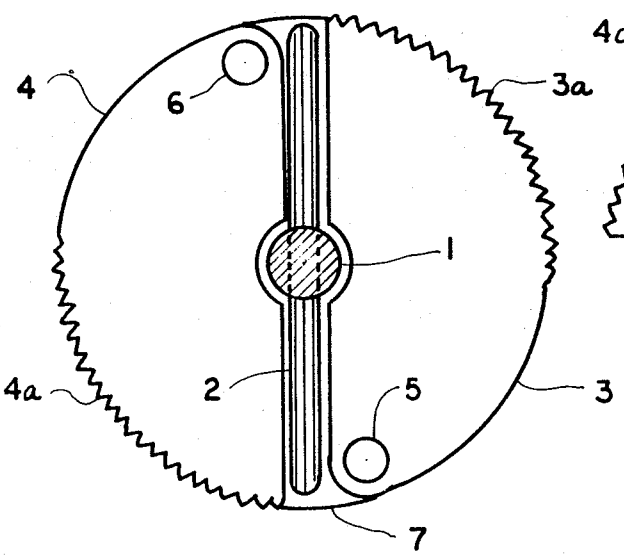
FIG. 1 is a top view of the anchoring device in its pre-expanded form.
Figure 4:
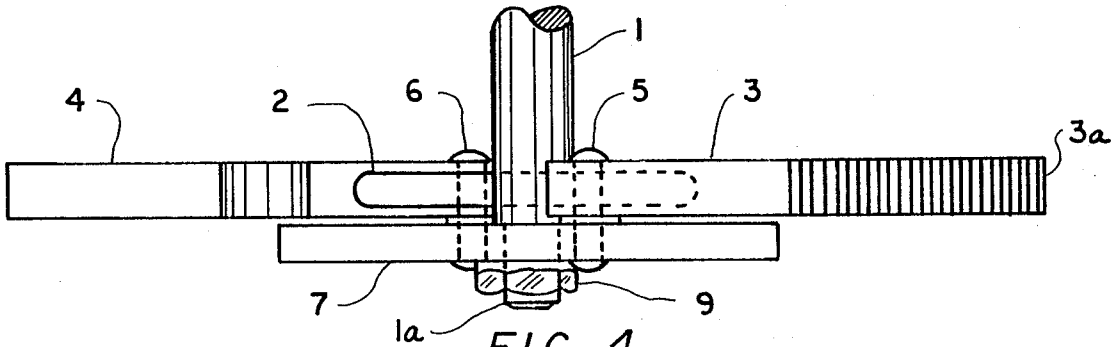
FIG. 4 is a side view of the anchoring device after full expansion has occurred.
Figure 3:
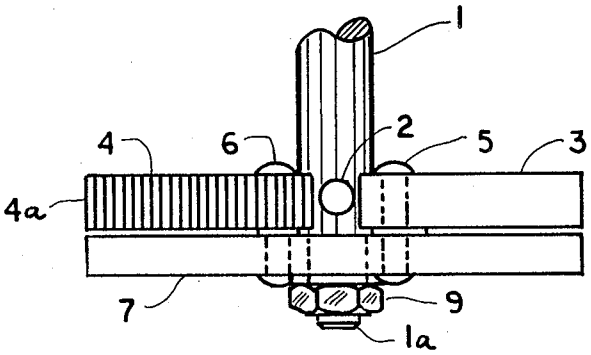
FIG. 3 is a side view of the anchoring device in its pre-expanded form.

FIGS. 1–4 show a generally metal anchoring device of the present invention wherein numeral 1 designates a rotatable bolt threaded at one end 1*a* which has rigidly attached thereto a perpendicular steel spring rod 2, extends equally in opposite directions from said bolt 1. Said bolt 1 passes centrally through a base plate 7 which has a hole in its center with a diameter slightly larger than the diameter of said bolt 1, thus allowing said bolt 1 to turn freely. Said base plate 7 is secured to the threaded end of said bolt 1 by nut 9.

Pivotally secured by bolts 5 and 6 to the upper side of said base plate 7 are two generally semicircular anchor plates 3 and 4 whose rounded external perimeters 3*a* and 4*a* are serrated in design for cutting a notch into the sidewall of a pre-drilled hole for securing of said anchoring device. Said plates 3 and 4, when at rest, are in stacked relationship and of a substantially equal circumference to said base plate 7.

FIG. 2 shows the present anchoring device in its partially expanded form which has been achieved by rotating said bolt 1 by a drilling device in a clockwise direction. This drilling action turns said rod 2 in a clockwise direction causing its end portions to contact the flat edges of said anchor plates 3 and 4, thus exerting force on the pivotally mounted plates, forcing their unattached ends to expand radially outwardly from said bolt 1 so as to cause serrated edges 3*a*, 4*a*, to engage the inner surface of the pre-drilled hole and begin cutting laterally and penetrating said sidewall. This cutting/anchoring process is completed when said anchor plates 3 and 4 have cut a deep enough notch into the sidewall of the pre-drilled hole to achieve maximum expansion. Once full expansion has been achieved, device will spin freely, thus alerting drill operator that said anchor plates are in place.

Figure 6:
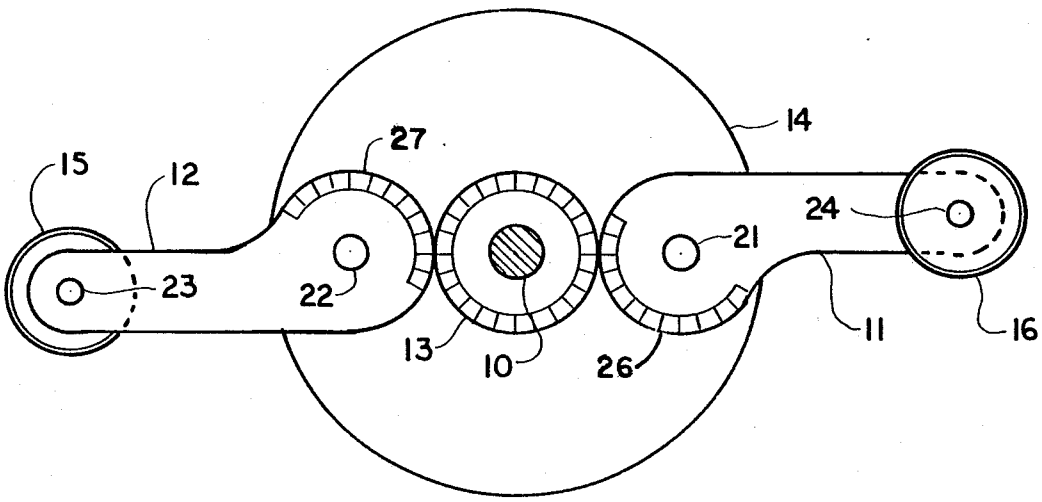
FIG. 6 is a top view of a modified anchoring device after full expansion has occurred.
Figure 5:
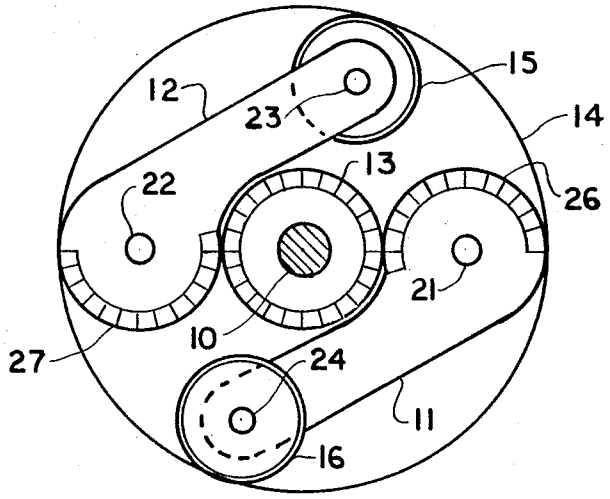
FIG. 5 is a top view of a modified anchoring device in its pre-expanded form.
Figure 7:
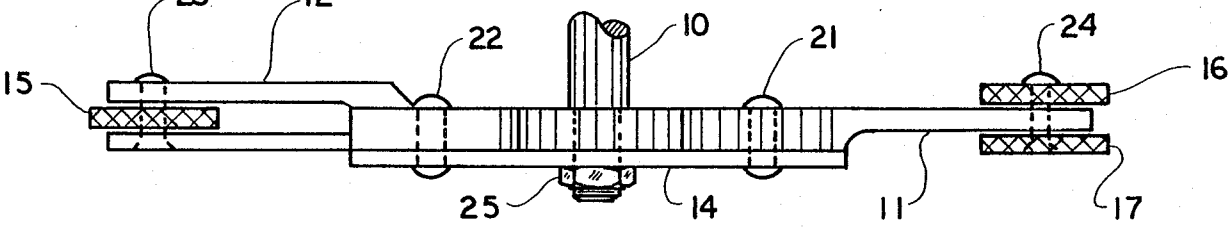
FIG. 7 is a side view of the modified anchoring device after full expansion has occurred.

FIGS. 5–7 show a modification of the generally metal anchoring device wherein numeral 10 denotes a rotatable bolt threaded at its lower end and having an integral gear 13 attached thereto. Said rotatable bolt 10 passes through a central hole in base plate 14. Said central hole having a diameter slightly larger than that of said rotatable bolt 10 so as to be independent of the motion of said rotatable bolt 10. Said base plate 14 is secured to threaded portion of said rotatable bolt 10 by nut 25. Pivotally secured to said base plate 14 by axles 21 and 22 are two cutting arm assemblies 11 and 12 whose toothed interior ends 26, 27, mesh with said integral gear 13. The terminal end of cutting arm 12 has attached thereto a spinable cutting wheel 15 operative by cutting wheel axle 23. The terminal end of cutting arm 11 has attached thereto a pair of cutting wheels 16, 17, operative by cutting wheel axle 24.

When a modified device is inserted into a pre-drilled hole and said rotatable bolt 10 is attached to a drilling device, the subsequent rotation causes cutting arms 11 and 12 to expand radially outwardly until cutting wheels 15–17 engage sidewalls of the hole.

At this point, base plate 14 locks and begins turning in direct relationship to rotatable bolt 10. Said cutting wheels 15–17 begin a lateral cutting of the sidewall. As drilling continues, said cutting wheels 15–17 penetrate the sidewall until maximum expansion of said cutting arms 11 and 12 has been achieved. Again, said anchoring device will spin freely to alert a drill operator of completion.

An advantage of this modified anchoring device is that the anchor can be retracted from the hole if so desired by reversing the drill and thus contracting said cutting arms 11 and 12 to their pre-expanded form.

Figure 8:
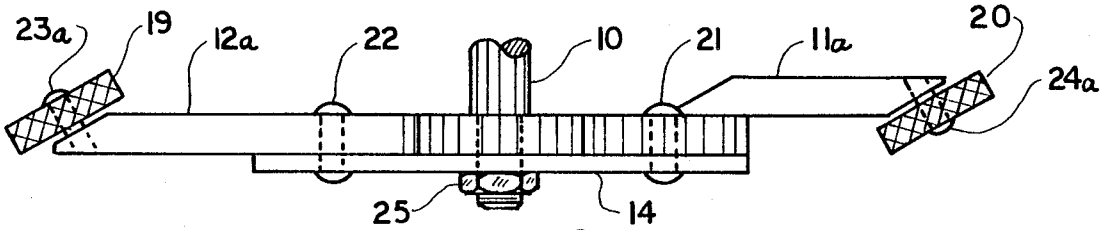
FIG. 8 is a side view of a variation of a modified anchoring device in its expanded form.
Figure 10:
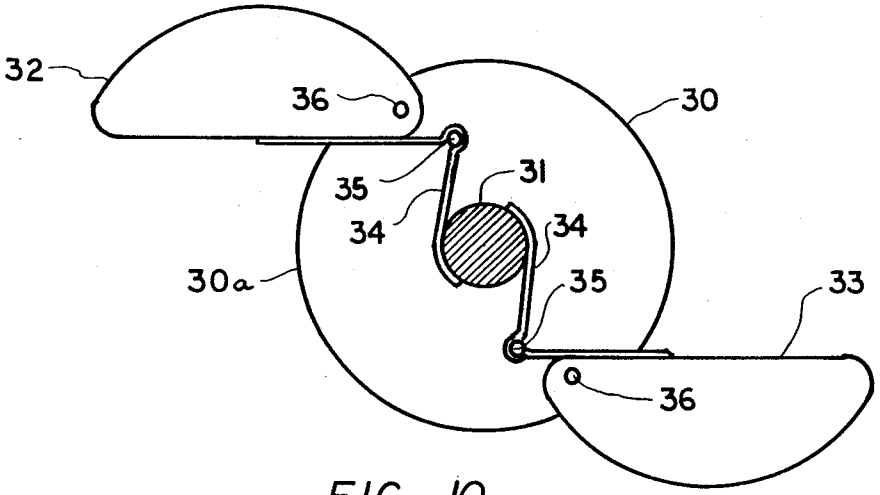
FIG. 10 is a top view of a further modified anchoring device in its expanded form.
Figure 9:
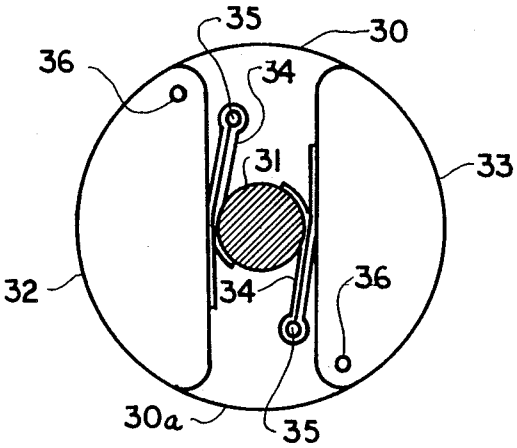
FIG. 9 is a top view of a further modified anchoring device in its pre-expanded form.

Shown in FIG. 8 is a suggested variation of the cutting arm/wheel structure. In this embodiment cutting arms 12*a* and 11*a* are provided with cutting wheels 19 and 20 respectively each operative by respective axles 23*a* and 24*a*.

FIGS. 9–12 show yet another modification of the generally metal anchoring device wherein numeral 30 denotes an anchoring device assembly comprising a base plate 30*a*, having an integral rotatable shaft 31 extending upwardly and at a 90 degree angle from its center. Spring operative and pivotally attached to said base plate 30*a* are two generally semi-circular anchor plates 32 and 33 which are in stacked relationship and generally similar in diameter to said base plate 30*a* when the anchoring assembly is in pre-expanded form. Plates 32 and 33 are pivotally secured by axles 36 and are operative by springs 34 which themselves are secured to plate 30*a* by elements 35.

In operation, this form of an anchoring device is placed in a pre-drilled hole whose sidewalls have been laterally excavated or notched as previously described. The sidewalls of the hole keep the anchoring device in its compact pre-expanded form until the spring operative anchor plates 32,33, align with the lateral notch in the sidewall at which time they expand outwardly, securing said anchoring device.

Figure 12:
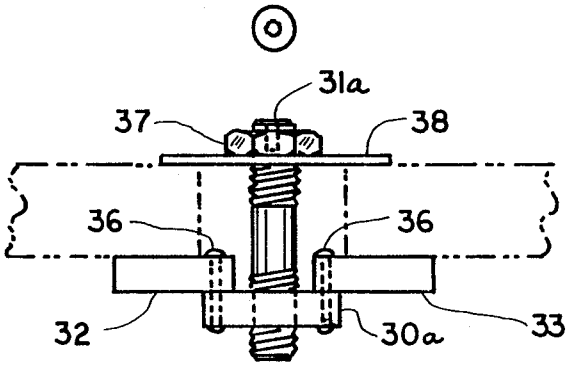
FIG. 12 shows a variation of the further modified anchoring device in its expanded form as it would appear in relationship to an open ended hole.
Figure 11:
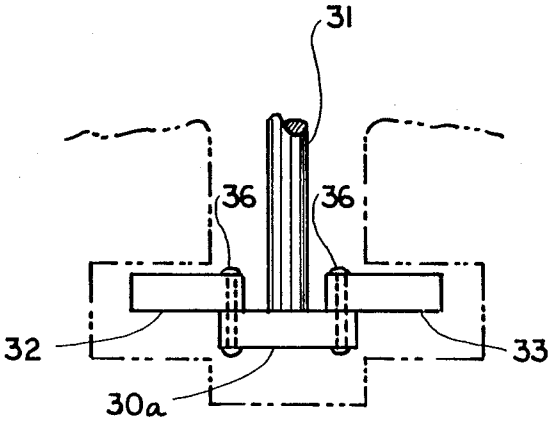
FIG. 11 is a side view of a further modified anchoring device in its expanded form as it would appear in relationship to a pre-drilled dead end hole.

FIG. 12 shows a variation of this modified anchoring device assembly wherein rotatable shaft 31*a* is threaded at both ends for use in open end hole applications.

Thus it will be seen that I have provided a novel anchoring device which will be applicable in a variety substances such as earth, rock, concrete, drywall, wood and other materials where anchoring is required. Furthermore, I have provided an anchoring device which can be inserted to various depths in a pre-drilled hole depending on the requirements of the anchoring situation.

While I have illustrated and described several embodiments of my invention, it will be understood that they are by way of illustration only and that various changes and other modifications are contemplated by my invention within the scope of the following claims.

I claim:

1. An expanding anchoring device comprising: a rotatable shaft, a base plate attached thereto, two pivotally mounted expanding members attached to said base plate, and an expansion means for moving said expanding members radially outwardly from said rotatable shaft, said expansion means being a spring steel rod passing through and rigidly attached to said rotatable shaft and extending equally in opposite directions from said shaft.

* * * * *